United States Patent [19]

Alberny et al.

[11] 4,067,378

[45] Jan. 10, 1978

[54] CONTINUOUS CASTING OF A METALLIC PRODUCT BY ELECTROMAGNETIC CENTRIFUGING

[75] Inventors: Robert Alberny; Jean-Pierre Birat, both of Metz; Roger Ventavoli, Algrange, all of France

[73] Assignee: Institut de Recherches de la Siderurgie Francaise (IRSID), St.-Germain-en-Laye, France

[21] Appl. No.: 763,971

[22] Filed: Jan. 31, 1977

[30] Foreign Application Priority Data

Feb. 11, 1976 France ..... 76.03802

[51] Int. Cl.[2] ..... B22D 11/10

[52] U.S. Cl. ..... 164/49; 164/84; 164/147

[58] Field of Search ..... 164/49, 82, 84, 147, 164/250

[56] References Cited

U.S. PATENT DOCUMENTS

| | | | |
|---|---|---|---|
| 2,963,758 | 12/1960 | Pestel et al. | 164/49 X |
| 3,995,678 | 12/1976 | Zavaros et al. | 164/147 X |
| 4,016,926 | 4/1977 | Yamoda et al. | 164/49 X |
| 4,026,346 | 5/1977 | Birat et al. | 164/147 |

*Primary Examiner*—Ronald J. Shore

*Attorney, Agent, or Firm*—Kurt Kelman

[57] ABSTRACT

A metallic product free of surface faults is continuously cast in a cooled, conductive ingot mold wherein a liquid metal is rotated by applying a magnetic field turning about the axis of the mold thereto and wherefrom the partially solidified metal product is extracted continuously. The driving action of the magnetic field is optimized by imparting to it a maximum value of frequency of rotation between 4 and 15 Hertz, this value being a function of the form and size of the cast product as well as the thickness and electric conductivity of the mold wall such that any increase in the frequency of rotation above this value brings about an attenuation of the frequency in the mold wall in excess of its positive effect on the rotation of the liquid metal.

4 Claims, 2 Drawing Figures

FIG_1_

CONTINUOUS CASTING OF A METALLIC PRODUCT BY ELECTROMAGNETIC CENTRIFUGING

Figure 1:
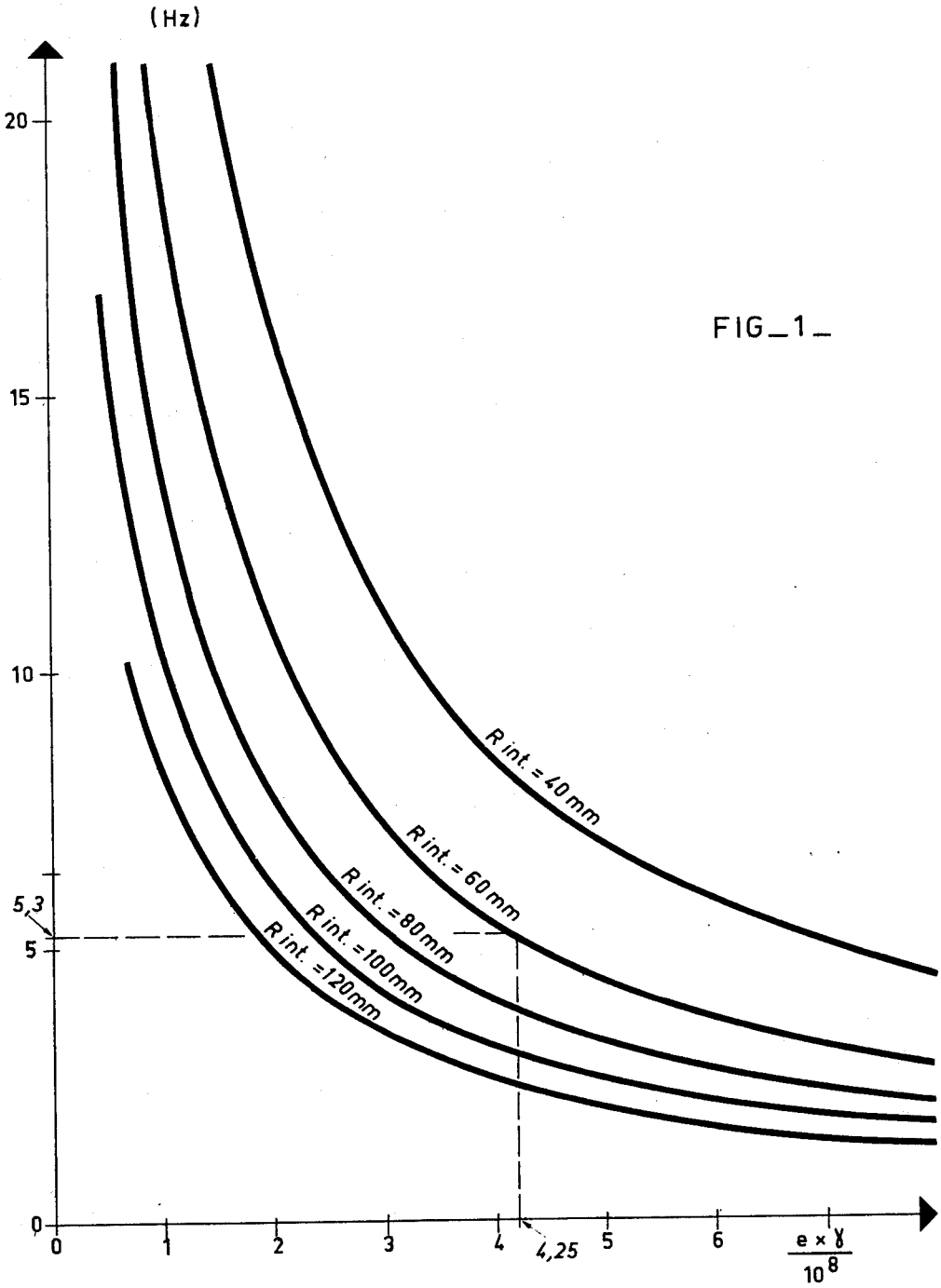

The present invention relates to improvements in the continuous casting of a metallic product, such as billets free of surface faults, wherein a liquid metal is rotated in an ingot mold by applying thereto a turning magnetic field.

It is known that numerous advantages in the quality of the cast product accrue from subjecting a liquid metal during continuous casting in an open-ended cooled mold to centrifugal action before the partially solidified product is extracted from the mold. The centrifugal force may be obtained by turning the mold about its axis or subjecting the liquid metal in the mold to a turning magnetic field while maintaining the mold stationary, either action causing the liquid metal in the mold to be rotated and thoroughly stirred. The latter method is mechanically simpler but it poses electromagnetic problems to whose solution U.S. patent applications Ser. No. 699,353, filed June 24, 1976, now U.S. Pat. No. 4,026,428 and Ser. No. 760,428 filed by us Jan. 18, 1977, entitled "Continuous Casting of a Metallic Product by Electromagnetic Centrifuging", address themselves. The disclosures of these applications are incorporated herein by way of reference.

One of the difficulties encountered in this latter method resides in properly determining the characteristics of the turning magnetic field so as to obtain rapidly and with certainty an industrially valuable result, without undue and costly experimentation.

It is the primary object of this invention readily to overcome this difficulty.

This and other objects are accomplished in accordance with the invention in a process for continuously casting a metallic product, wherein a liquid metal is injected into an open top of a cooled ingot mold, the metal is rotated in the mold by applying thereto a magnetic field turning about the axis of the mold, and the metal product is extracted from the open bottom of the mold in partially solidified condition, by the step of optimizing the driving force of the turning magnetic field by giving a maximum value in the range of 4 to 15 Hertz to the frequency of rotation of the magnetic field, the maximum value being a function of the form and size of the cast product as well as the thickness and electric conductivity of the mold wall, such that each increase in the frequency above this value brings about an attenuation of the force in the mold wall in excess of its positive effect on the driving force exerted upon the metal.

In the drawings

Figure 2:
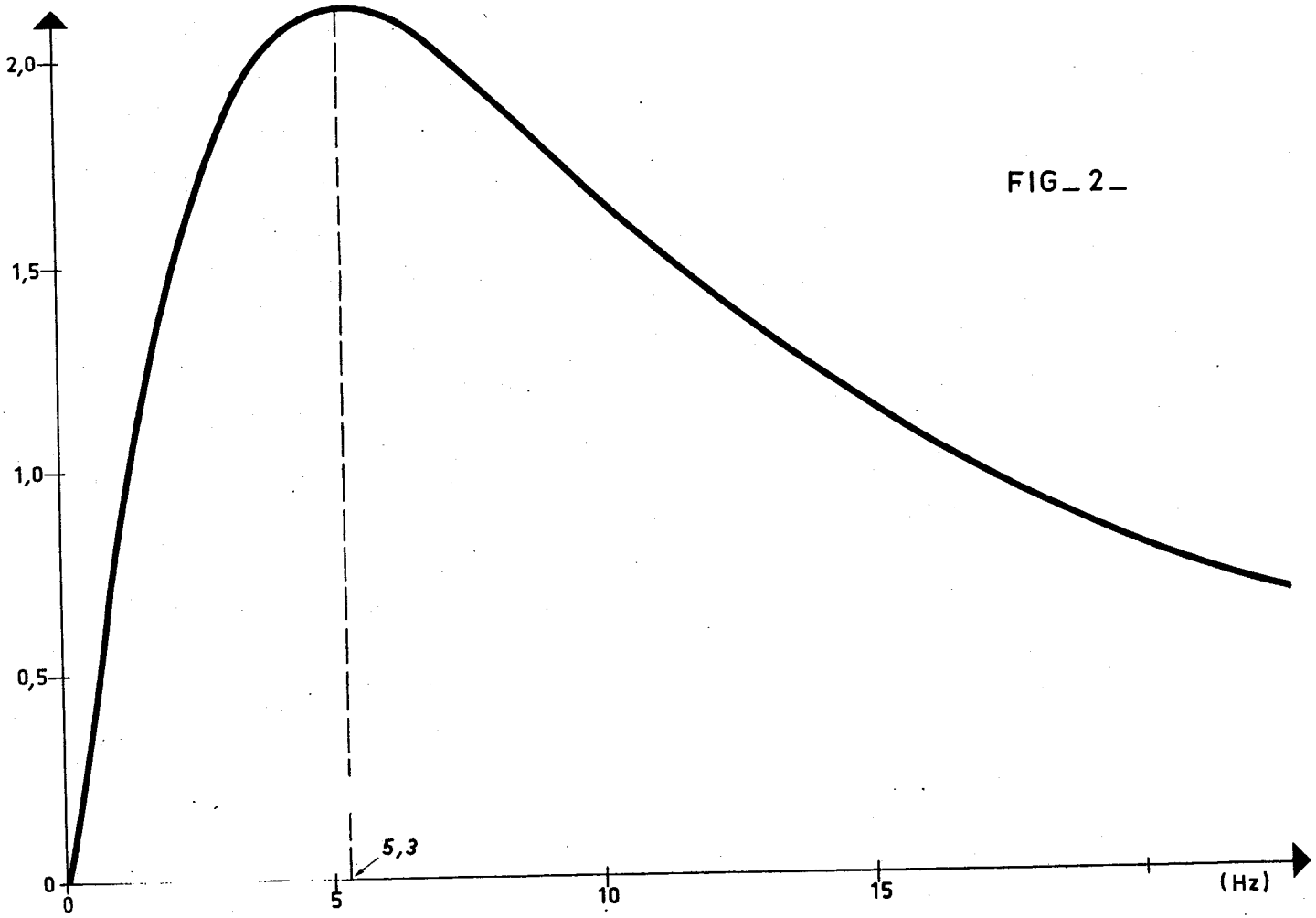

FIG. 1 defines the frequency of rotation N of the magnetic field applied to the liquid metal in the mold as a function of the simple product e of the thickness and the conductivity of the mold wall for different forms and sizes of the cast product and FIG. 2 shows, for a mold with an internal radius of 6cm., the frequency experimentally determined by measuring the electromagnetic coupling by means of a magnetic guage suspended in the mold and connected by a torsion wire to an instrument for measuring the angle of torsion.

According to one embodiment of the present invention, this maximum value, i.e. the optimum frequency, is determined simply by reading from control graphs described hereinbelow in connection with FIG. 1.

According to another embodiment of this invention, the optimum frequency of rotation of the magnetic field is determined by the following equation:

$$N_{opt} = \frac{100}{AX^2 + BX + C}$$

wherein X is the product $e\,\gamma 10^8$, $e$ being the thickness of the mold wall (in mm) and $\gamma$ being the electric condutivity of the wall (in mho/m), A, B and C are parameters depending on the internal radius R (in cm) of the mold, i.e. the form and size of the cast product, according to the following approximate equations:

$$A = 0.011\,R^3 - 0.226\,R^2 + 1{,}494\,R - 3.409$$

$$B = -\,0.03763\,R^2 + 0.956\,R + 1.687$$

$$C = 0.1585\,R^2 - 1.534\,R + 1.192$$

According to a preferred feature of the invention, the effective intensity of the magnetic field whose frequency of rotation is determined in the indicated manner is so controlled that the value of the field intensity at the axis of the mold is within a lower limit Bi and an upper limit Bs respectively defined by the following equations:

$$Bi = 4\exp\left[-\left(\frac{N^2}{10}\right)\right](270 - 17\,N)$$

$$Bs = 4\,exp\left[-\left(\frac{N^2}{10}\right)\right](400 - 25\,N)$$

wherein the values B$i$ and B$s$ of the magnetic field are expressed in Gauss and N is the frequency of rotation of the magnetic field expressed in Hertz.

One of the first questions faced by those skilled in the art practicing the continuous casting process with which the invention deals is the selection of the angular velocity or frequency of rotation of the magnetic field when the field is produced, in the conventional manner, by a polyphase inductor with the frequency of the available current with which it is operated.

While the prior art has dealt with frequencies as high as 50 Hz or even higher, and a low as 20 Hz down to less than 10 Hz, we have suggested in our last-mentioned copending patent application a preferred frequency of 4 to 15 Hz. Within this range, there is an optimum frequency which develops a maximum driving or rotary force acting upon the liquid metal in the mold. In the absence of the weakening of the magnetic field by the electrically conductive mold wall, this driving force acting upon the liquid metal increases with the frequency of rotation of the field. However, the weakening of the magnetic field due to the induced currents in the conductive mold wall also grows with the frequency of the current. Therefore, there is an optimum value of frequency, which depends on the form and size of the cast product, i.e. that of the mold chamber defined by the mold wall, as well as the thickness and electric conductivity of the mold wall, above which the weakening of the magnetic field surpasses the increase in the driving force. At this point, the driving force will decrease if the frequency were increased.

On the basis of this hypothesis, we have constructed graphs enabling those practicing this continuous casting process immediately and without further effort to determine the frequency of rotation of the magnetic field appropriate to the characteristics of the mold. By the same token, for a given electric current supply and inductor, these charts make it possible to determine the thickness and conductivity of the mold walls.

We have found that the thickness and conductivity of the mold wall determine the optimum frequency of rotation of the magnetic field symmetrically, i.e. by their simple product.

The graphs in FIG. 1 define the frequency of rotation N of the magnetic field applied to the liquid metal in the mold as a function of the simple product $e\gamma$ of the thickness and the conductivity of the mold wall for different forms and sizes of the cast product, i.e. for different sizes of mold chambers defined by the mold walls.

This form and size is represented by radius R of a circle which is tangent to the interior walls of the mold in a plane normal to the axis of the mold. In the case of a cylindrical mold, R is simply the interior radius of the mold cylinder. The extreme values of radius R are 40 and 120 mm, respectively, which constitutes the entire range of metallic products generally produced by continuous casting.

The analytical expression of the curves of the chart shown in FIG. 1 may be expressed by the above-given equation:

$$N_{opt} = \frac{100}{AX^2 + BX + C}$$

Once the optimum frequency of rotation of the magnetic field has been established for a given mold, the field intensity must be set to obtain the best possible result. The velocity of rotation of the liquid metal in the mold chamber depends specifically in this field intensity.

It is known that, due to the centrifugal effect of the rotation, the free surface of the liquid metal (its meniscus) is depressed in the center and rises along the walls of the mold, assuming a substantially parabolic shape. This shape of the meniscus, together with the fact that the scum has a density less than that of the metal, results in the tendency of the scum to gather in the middle if the velocity of the rotating metal is sufficient. Therefore, it is important that this velocity have a minimum value to make certain that the scum be gathered in the middle but does not exceed a maximum value beyond which the meniscus would be so depressed in the middle that the operator would have difficulty in removing the scum. Furthermore, excessive velocity may also cause the scum to descend from the middle of the liquid metal by a vortex effect. Another lower limit for the rotary velocity is determined by the necessity to obtain sufficient agitation in the metal bath to brake up the dentrites of basaltique solidification and to avoid the formation along the axis of the product of small pockets of liquid metal resulting from accidental discontinuities in the solidification and leading to small solidified pits and hollows. This lower limit, however, is less than the limit assuring gathering of the scum in the middle of the meniscus and, therefore, it need not be considered separately. The upper and lower field intensity limits are preferably determined according to the above-indicated equations.

By way of example and without limitation to the scope of the present invention, the following working example will illustrate the practice of this invention.

A continuous casting installation for producing round steel billets of 120 mm diameter was equipped with an ingot mold provided with a two-phase inductor with one pair of poles per phase and fed by a commercially available static thyristor-type converter which may deliver a maximum current intensity of 350 Amperes at 55 Volts per phase and a frequency between 3.5 and 13 Hz. The mold was built according to above-mentioned U.S. patent application Ser. No. 699,353, with a mold wall of copper alloyed with chromium and zirconium, the alloy having structural rigidity and the wall having a thickness of 11 mm, with an electric conductivity equal to $3.87 \times 10^7$ mho/m.

With an internal radius of the mold of 6 cm, the graphs of FIG. 1 show an optimum frequency of rotation of the magnetic field of 5.3 Hz. The optimum frequency experimentally determined by measuring the electromagnetic coupling by means of a magnetic gauge suspended in the mold and connected by a torsion wire to an instrument for measuring the angle of torsion is 5.3 Hz, as appears from the curve of FIG. 2. It should be stated that there is less conformity by applying the analytical expression of the frequency. In this case, an optimum frequency of 5 Hz is found.

At this frequency, the scum gathered in the center of the meniscus and was easy to remove by maintaining a magnetic field of 400 to 570 Gauss in the liquid metal. These relationships give values which approach within 10% the most convenient operating conditions.

It will be understood that the indicated relationships of the magnetic field as a function of the frequency are equally useful if frequencies other than the optimum frequency must be used, due to the fact that the latter cannot be obtained with the available electric generator.

We claim:

1. In a process for continuously casting a metallic product, wherein a liquid metal is injected into an open top of a cooled ingot mold having a mold chamber defined by the wall of the mold, the chamber having an axis and a radius, the metal is rotated in the mold chamber by applying thereto a magnetic field turning about the axis, and the metal product is extracted from an open bottom of the mold is partially solidified condition, the turning magnetic field imparting a driving force to the liquid metal in the mold chamber and the frequency of rotation of the magnetic field being held in the range of 4 to 15 Hz, the driving force being directly proportional to the frequency and inversely proportional to the induced currents in the mold wall caused by an increase in the frequency, the improvement comprising the step of setting the maximum value of the driving force as a function of the radius of the mold chamber and the thickness and electric conductivity of the mold wall, this value being determined by the highest frequency permissible to increase the driving force before the frequency is so high that the currents induced thereby in the mold wall decrease the driving force below the maximum value.

2. The process of claim 1, wherein the optimum frequency of rotation of the magnetic field is set as a function of the mold chamber radius and the thickness and electric conductivity of the mold wall by reference to the control graphs of the chart of FIG. 1.

3. The process of claim 1, wherein the optimum frequency of rotation of the magnetic field is set by the following equation:

$$N_{opt} = \frac{100}{AX^2 + BX + C}$$

wherein X is the product $e\gamma/10^8$, $e$ being the thickness of the mold wall (in mm) and $\gamma$ being the electric conductivity of the wall (in mho/m), A, B and C are parameters depending of the internal radius R (in cm) of the mold, i.e. the form and size of the cast product, according to the following approximate equations:

$$A = 0.011\,R^3 - 0.226\,R^2 + 1.494\,R - 3.409$$

$$B = -\,0.03673\,R^2 + 0.956\,R + 1.687$$

$$C = 0.1585\,R^2 - 1.534\,R + 1.192.$$

4. The process of claim 1, wherein the effective current intensity of the magnetic field is so controlled that the value of the field intensity at the axis of the mold is within a lower limit Bi and an upper limit Bs respectively defined by the following equations:

$$Bi = 4\exp\left[-\left(\frac{N^2}{10}\right)\right](270 - 17\,N)$$

$$Bs = 4\,exp\left[-\left(\frac{N^2}{10}\right)\right](400 - 25\,N)$$

wherein the values Bi and Bs of the magnetic field are expressed in Gauss and N is the frequency of rotation of the magnetic field expressed in Hertz.

* * * * *